United States Patent [19]

Meyer

[11] Patent Number: 4,890,330

[45] Date of Patent: Dec. 26, 1989

[54] HEARING AID WITH INTERCHANGEABLE BATTERY COMPARTMENT AND AUDIO CONNECTION

[75] Inventor: Serge-E-H Meyer, Oberlunkhofen, Switzerland

[73] Assignee: Siemens Aktiengesellschaft, Berlin & Munich, Fed. Rep. of Germany

[21] Appl. No.: 227,291

[22] Filed: Aug. 2, 1988

[30] Foreign Application Priority Data

Aug. 11, 1987 [CH] Switzerland ..... 3067/87

[51] Int. Cl.[4] ..... H04R 25/00

[52] U.S. Cl. ..... 381/69.2; 381/68; 381/68.7

[58] Field of Search ..... 381/68.7, 69.2, 68, 381/69.1

[56] References Cited

U.S. PATENT DOCUMENTS 2,794,085 5/1957 Angelis ..... 381/69.2
4,137,431 1/1979 Pallesen ..... 381/68.7
4,548,082 10/1985 Engebretsen et al. ..... 73/585
4,564,955 1/1986 Birch et al. ..... 381/68.7

FOREIGN PATENT DOCUMENTS 87668 9/1983 European Pat. Off. ..... 381/68
3723809 1/1989 Fed. Rep. of Germany ..... 381/68

OTHER PUBLICATIONS

Selectra Brochure, Rexton International.
Advertisement for ITE Horizontal 13 Battery Dorr, 1986 NHAS ASHA Product Prospectus.

*Primary Examiner*—Jin F. Ng
*Assistant Examiner*—Danita R. Byrd
*Attorney, Agent, or Firm*—Hill, Van Santen, Steadman & Simpson

[57] ABSTRACT

A hearing aid has a housing to which a standard battery compartment can be removably attached, or to which an audio connection, including a battery compartment, can be optionally removably attached in place of the standard battery compartment. The necessity of an external audio connection, which adds to the size of the hearing aid, is thus eliminated.

5 Claims, 2 Drawing Sheets

HEARING AID WITH INTERCHANGEABLE BATTERY COMPARTMENT AND AUDIO CONNECTION

BACKGROUND OF THE INVENTION

1. Field of the Invention

The present invention is directed to hearing aids of the type usable with an audio connection.

2. Description of the Prior Art

Behind-the-ear hearing aids are commercially available which are optionally usable with an audio connection to permit the hearing aid to be directly electrically connected to various audio devices. Such a commercially available hearing aid is the SELECTRA model offered by Rexton International of Zurich, Switzerland. The audio connection, when attached, enlarges the dimensions of the hearing aid to an undesirable extent.

In-the-ear hearing aids are also known wherein battery compartments respectively designed for different sizes of batteries can be substituted for one another. Such a product is commercially available from ITE as described, for example, in the 1986 NHAS ASHA Product Prospectus. In the SELECTRA behind-the-ear hearing aid, the battery compartment cannot be replaced without dismantling the housing shells.

SUMMARY OF THE INVENTION

It is an object of the present invention to provide a hearing aid having an audio connection which maintains the size of the hearing aid as small as possible.

The above object is achieved in accordance with the principles of the present invention in a hearing aid having a housing to which a standard battery compartment, or an audio connection having a built-in battery compartment, can be optionally attached in place of each other.

In the hearing aid disclosed herein, the standard battery compartment can be removed from the housing, and an audio connection, which includes a battery compartment, can be attached to the housing instead of the standard battery compartment. Although the size of the audio connection including the battery compartment is slightly larger than the size of the standard battery compartment, it is significantly smaller than a conventional audio connection, and thus the overall unit formed by the housing and the audio connection including the battery compartment is maintained at a relatively small size.

In further embodiments of the invention, additional electronic components can be accommodated within the audio connection as needed. It is also possible to provide a third version of a battery compartment attachable to the housing, this third version having a shape similar to that of the audio connection but not having terminal contact receptacles, as does the audio connection. Selected electrical and/or electromechanical elements can be contained within the shell of this third version, which also includes a battery compartment. These additional elements may be, for example, special control or programming chips. Both the audio connection and the shell include a contact holder having spring contacts; in the audio connection these spring contacts are used to provide an electrical connection to the prongs of a standard Euro-plug inserted in the audio connection, and in the shell these springs are used to attach the electrical and/or electro-mechanical elements to the remainder of the hearing aid circuitry.

DESCRIPTION OF THE PREFERRED EMBODIMENTS

Figure 1:
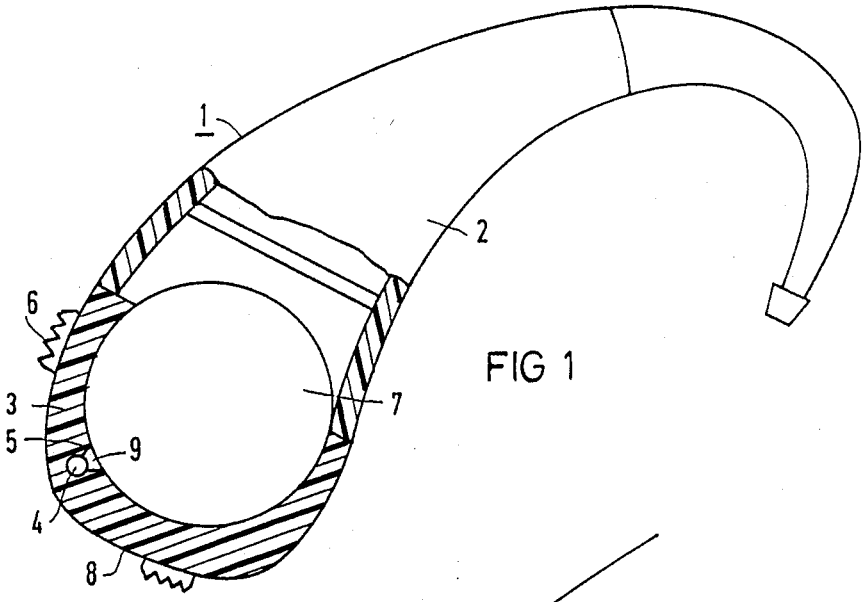
FIG. 1 is a side view, partly in section, of a hearing aid constructed in accordance with the principles of the present invention having a standard battery compartment attached thereto.

As shown in FIG. 1, a hearing aid 1 has a housing 2 with a standard battery compartment 3 attached thereto. The standard battery compartment 3 is rotatably hooked for movement around an axis of revolution, such as a pivot pin 4 projecting from each housing shell, the housing 2 consisting of two such housing shells. The pivot pin 4 is received in a slot 5 in the standard battery compartment 3. The standard battery compartment 3 also has a push-button 6 for engaging the standard battery compartment 3 in a completely closed position, wherein a battery 7, contained in the standard battery compartment 3 is electrically connected to the internal circuitry (not shown) of the hearing aid 1. The push-button 6 can also be used to move the standard battery compartment 3 to a half-open position, wherein the battery 7 is disconnected form the internal circuitry. The push-button 6 can also be used to swivel the standard battery compartment 3 completely away from the end face 8 of the hearing aid 1, so that the battery 7 can be easily replaced. The complete standard battery compartment 3 can be disconnected from the pivot pin 4 by spreading the opening 9 of the slot 5. Upon removal of the standard battery compartment 3 from the housing 2, it can be replaced by an audio connection, including a battery compartment, as described below.

Figure 2:
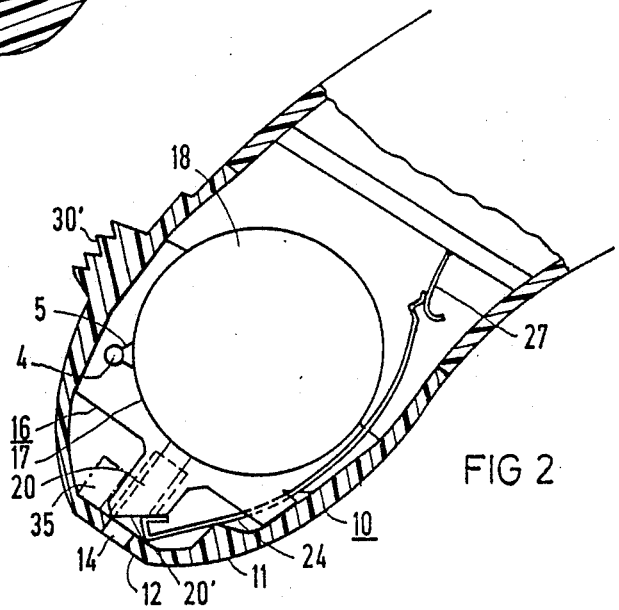
FIG. 2 is a enlarged side view, partly in section, of a portion of a hearing aid constructed in accordance with the principles of the present invention having an audio connection including a battery compartment attached thereto.
Figure 3:
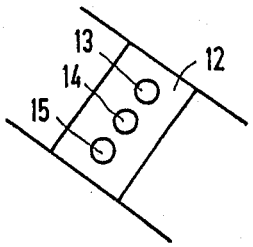
FIG. 3 is a plan view of the distal end of the audio connection shown in FIG. 2.

FIGS. 2 and 3 show such an audio connection 10 which includes a battery compartment, and which is attached to the pivot pin 4 of the housing 2 instead of the standard battery compartment 3. The audio connection 10 has an outer shell 11. The shell 11 has an end face 12, shown in FIG. 3, which has a plurality, such as three, female connector bushings 13, 14 and 15 for accepting a standard plug, such as a Euro-plug (not shown). The audio connection 10 also has a contact holder 16 introduced into the shell 11, the contact holder 16 having a battery compartment 17, shown with a battery 18 inserted therein (the battery 18 may be identical to the battery 7 of FIG. 1).

Figure 4:
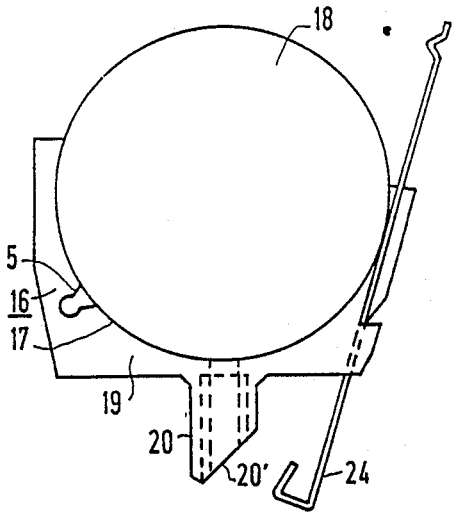
FIG. 4 is a side view of a contact holder for the audio connection shown in FIG. 2, including a battery compartment.
Figure 5:
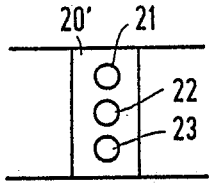
FIG. 5 is a plan view of the end face of the contact holder shown in FIG. 4.

The shape of the contact holder 16, including the battery compartment 17, is shown in more detail in FIGS. 4 and 5. The contact holder 16 has a seating portion 19 for the battery 18 and a plug portion 20 for the connector bushings 13 through 15 at the end face 12 of the outer shell 11 of the audio connection 10. As shown in the plan view of FIG. 5, the plug portion 20 has female connector bushings 21, 22 and 23 which form continuations of the bushings 13 through 15 when the contact holder 16 is mounted in the outer shell 11.

Figure 6:
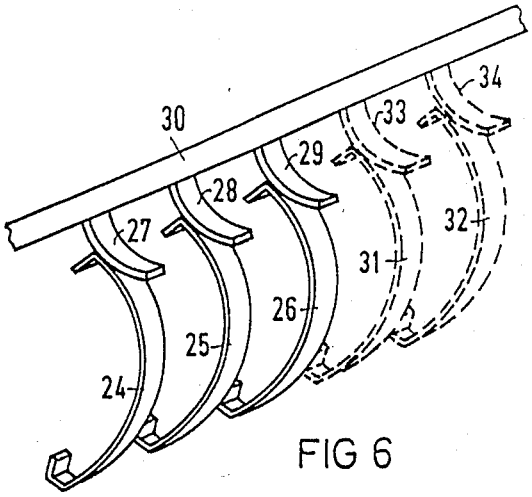
FIG. 6 is a perspective view of the spring contacts for the contact holder shown in FIG. 4.

As shown in FIG. 6, the contact holder 16 may have a plurality of contact springs 24, 25 and 26, one of which (contact spring 24) is visible in the side view of FIG. 4. In the normal case, the contact holder 16 will have three such contact springs which, when the contact holder 16 is introduced into the shell 11, are pressed by the inside wall of the shell 11 in the direction of the connector bushings 13 through 15, and in the direction of the connector bushings 21 through 23. An inserted plug, such as a Euro-plug, will be in contact with the lower ends of the contact springs 24 through 26 when pressed inwardly in such a manner. The contact connection at the upper end of the contact springs ensues via respective contact springs 27, 28 and 29, which project downwardly in the direction of the audio connection 10 from a printed circuit board 30.

At the exterior of the shell 11, the audio connection 10 has a finger grip 30' for connecting and disconnecting the battery 18 to the internal circuitry (not shown) of the hearing aid 1.

As also shown in FIG. 6, the contact holder 16 may have additional contact springs, such as contact springs 31 and 32 shown in dashed lines, which engage contact springs 33 and 34 attached to the printed circuit board 30. The additional contact springs may be used to provide connections to further electrical and/or electromechanical components accommodated in the audio connection 10. One such additional component 35 is schematically shown in FIG. 2 in dashed lines.

Figure 7:
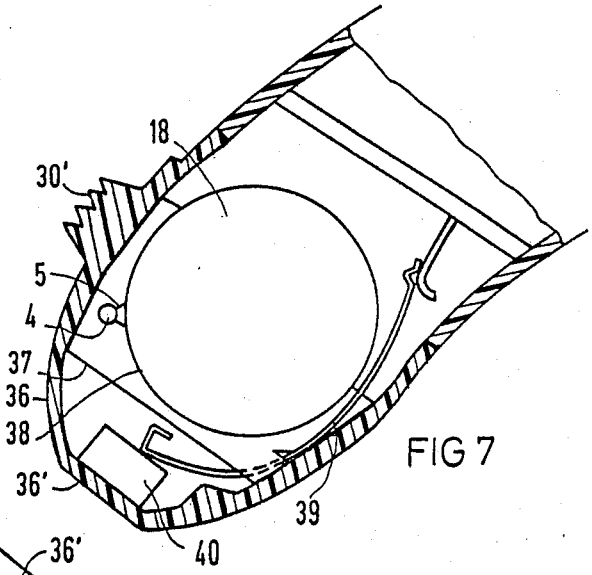
FIG. 7 is a side sectional view of a portion of a hearing aid constructed in accordance with the principles of the present invention having a shell with additional components therein attached to the housing.
Figure 8:
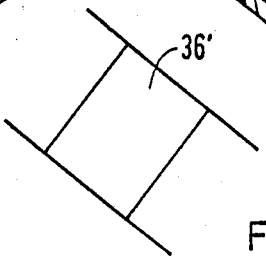
FIG. 8 is a plan view of the distal end of the shell of FIG. 7.

As shown in FIGS. 7 and 8, the standard battery compartment 3 or the audio connection 10 can optionally be replaced by a third component, this being a shell 36 having an outer shape approximating the shape if the shell 11 of the audio connection 10, but not having receptacles for accommodating a plug. As shown in FIG. 8, the distal end face 36' of the shell 36 is solid. The shell 36 has a contact holder similar to the contact holder 16 of the audio connection 10, but not having the plug portion 20'. The contact holder 37 has a battery compartment 38 and a plurality of contact springs, one such contact spring 39 being shown in FIG. 7. The contact springs, such as the contact spring 39, are electrically connectable to a plurality of electrical and/or electro-mechanical components, one such component being shown at 40 in FIG. 7. The components such as the component 40 are also disposed in the shell 36. These components may be, for example, control/programming chips.

Figure 9:
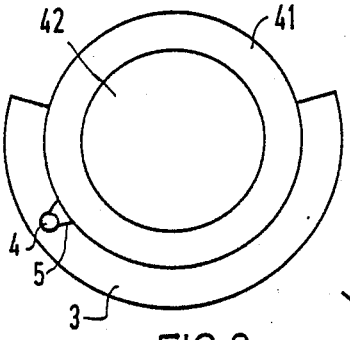
FIG. 9 is a side view showing accommodations which can be made to the battery compartment in all of the above embodiments for different battery sizes.

As shown in FIG. 9, any one of the battery compartments 3, 17 or 38 (only battery compartment 3 being shown in FIG. 9) can be adapted to receive batteries of different sizes. This is accomplished by a reducing ring 41 received in the battery compartment 33. The battery compartments, such as the standard battery compartment 3, have an inside diameter matched to the largest size battery which may be used, and the reducing ring 41 has an inner diameter matched to smaller batteries, such as a battery 42.

Although modifications and changes may be suggested by those skilled in the art it is the intention of the inventor to embody within the patent warranted hereon all changes and modifications as reasonably and properly come within the scope of his contribution to the art.

I claim as my invention:

1. A hearing aid comprising:

a housing having an attachment element; and a set of removably engageable components including a standard battery compartment removably engageable with said attachment element to form a unit with said housing, and an audio connection including a battery compartment, said audio connection also being removably engageable with said attachment element of said housing to form a unit with said housing in place of said standard battery compartment.

2. A hearing aid as claimed in claim 1, wherein said audio connection comprises:

an outer shell removably engageable with said attachment element of said housing; and a contact holder forming a battery compartment disposed within said shell.

3. A hearing aid as claimed in claim 2, wherein said hearing aid has internal circuitry, and wherein said outer shell includes means for manually switching said battery to a position in electrical connection with said internal circuitry and to a position disconnected from said internal circuitry.

4. A hearing aid as claimed in claim 2, wherein said audio connection includes a plurality of electrical components contained within said shell, and wherein said contact holder includes a plurality of electrical contacts for a standard audio plug, and a plurality of further electrical contacts for said electrical components.

5. A hearing aid as claimed in claim 1, wherein said standard battery compartment and said battery compartment of said audio connector has a size for receiving a largest battery, and further comprising a reducing ring receivable in both said standard battery compartment and said battery compartment in said audio connector, said reducing ring having an inner diameter matched to accommodate batteries smaller than said largest battery.

* * * * *